US005732820A

United States Patent [19]

Tsai

[11] Patent Number: 5,732,820

[45] Date of Patent: Mar. 31, 1998

[54] STICK OBJECT STORAGE BOX

[76] Inventor: Hung Chic Tsai, 3F, No. 26, Swang Chen Street, Taipei, Taiwan

[21] Appl. No.: 758,177

[22] Filed: Nov. 25, 1996

[51] Int. Cl.[6] ..... B65D 5/52

[52] U.S. Cl. ..... 206/369; 206/45.23; 206/443

[58] Field of Search ..... 206/368, 369, 206/370, 379, 443, 45.2, 45.23; 220/351, 345, 346

[56] References Cited

U.S. PATENT DOCUMENTS

| | | | |
|---|---|---|---|
| 1,247,848 | 11/1917 | List | 206/45.23 |
| 3,783,999 | 1/1974 | Smith | 206/45.2 |
| 4,420,079 | 12/1983 | Gliniorz et al. | 206/45.23 |
| 4,615,461 | 10/1986 | Liu | 206/45.23 |
| 4,634,001 | 1/1987 | Wakelin | 206/45.2 |
| 4,666,036 | 5/1987 | Bourbon | 206/45.2 |
| 4,986,415 | 1/1991 | Posso | 206/45.23 |
| 5,372,249 | 12/1994 | Grange | 206/45.2 |

*Primary Examiner*—B. Dayoan
*Assistant Examiner*—Luan K. Bui
*Attorney, Agent, or Firm*—Bacon & Thomas

[57] ABSTRACT

A stick object storage box adapted for holding for example floss sticks, including a rectangular box body, and a sliding cover coupled to the box body by a slip joint, the sliding cover having two inward stub rods bilaterally disposed at the front end and moved in two longitudinal sliding grooves at two opposite sides of the box body. By moving the inward stub rods in the longitudinal sliding grooves and turning the sliding cover relative to the box body, the box body can be supported on the sliding cover in a tilted position in an open status.

2 Claims, 3 Drawing Sheets

STICK OBJECT STORAGE BOX

BACKGROUND OF THE INVENTION

The present invention relates to a stick object storage box adapted for holding for example floss sticks, and relates more particularly to such a stick object storage box which can be arranged in a tilted position on a flat surface when opened, so that the user can conveniently pick up the storage items from the box.

Toothbrushes are commonly used for cleaning the teeth. However, cleaning the teeth with a toothbrush cannot effectively remove bits of food from the teeth. In order to remove bits of food from the teeth effectively, a toothpick, floss, or floss stick may be used. When using a toothpick to remove bits of food from the teeth, the gum tends to be injured by the pointed tip of the toothpick. Furthermore, a toothpick cannot reach small gaps in the teeth. A floss stick is one of the most inexpensive and effective devices for removing bits of food from the teeth, because it achieves the effect of a toothpick and a floss. However, few restaurants would like to provide floss sticks for consumers because it is difficult to find a suitable floss stick storage box that can be conveniently opened, and set in position for easy access of the floss sticks stored therein.

SUMMARY OF THE INVENTION

It is one object of the present invention to provide a stick object storage box which can be easily arranged in an open condition convenient for access of the storage items. It is another object of the present invention to provide a stick object storage box which can be firmly supported on a flat surface in a tilted position when opened, so that the user can conveniently pick up storage items from the box. According to the present invention, the stick object storage box is comprised of a rectangular box body, and a sliding cover coupled to the box body by a slip joint. When the sliding cover is opened, it can be turned over the front side of the box body without disengaging the slip joint, and then perpendicularly attached to the bottom side of the box body, so that the box body can be supported on the sliding cover on a flat surface in a tilted position.

DETAILED DESCRIPTION OF THE PREFERRED EMBODIMENT

Figure 1:
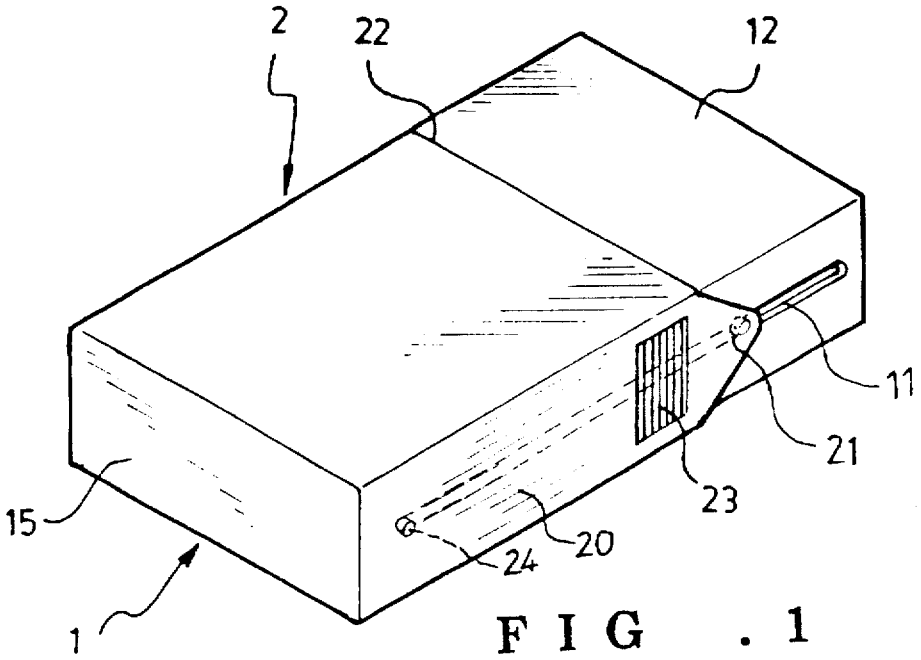
FIG. 1 is a perspective elevational view of a stick object storage box according to the present invention.
Figure 2:
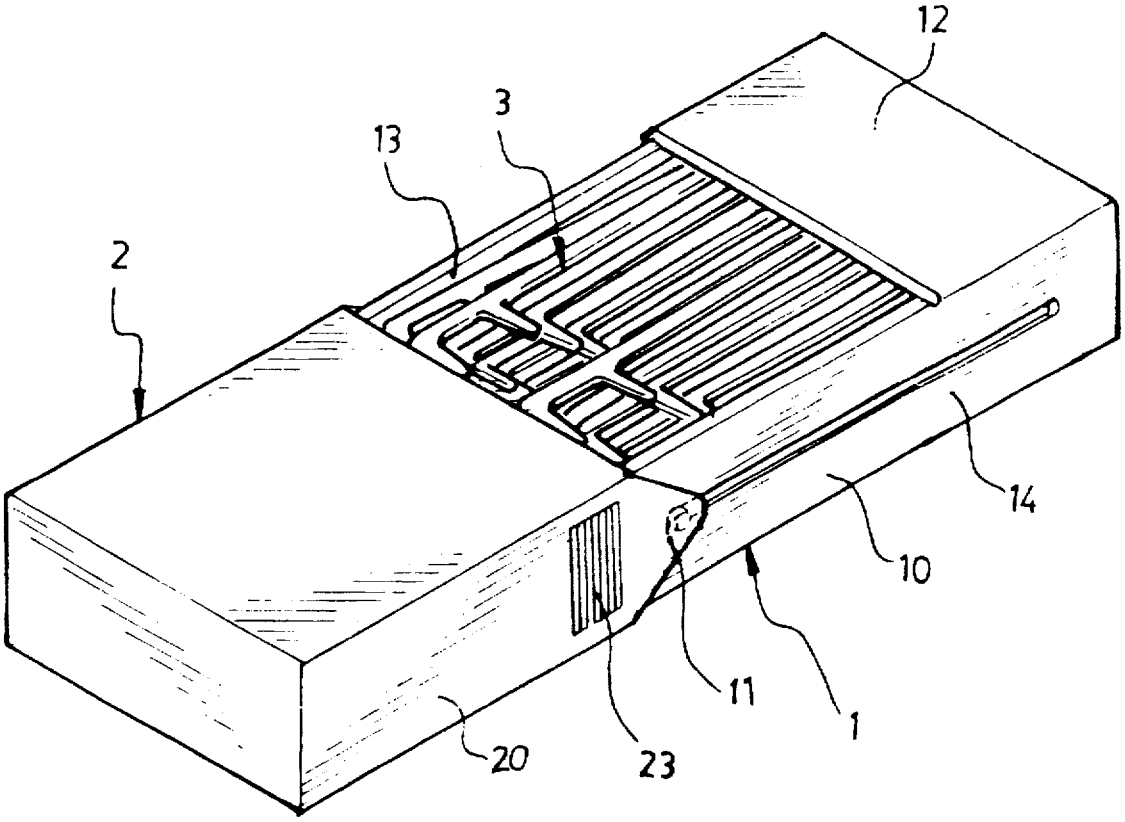
FIG. 2 is another elevational view of the stick object storage box according to the present invention, showing the sliding cover opened from the box body.
Figure 3:
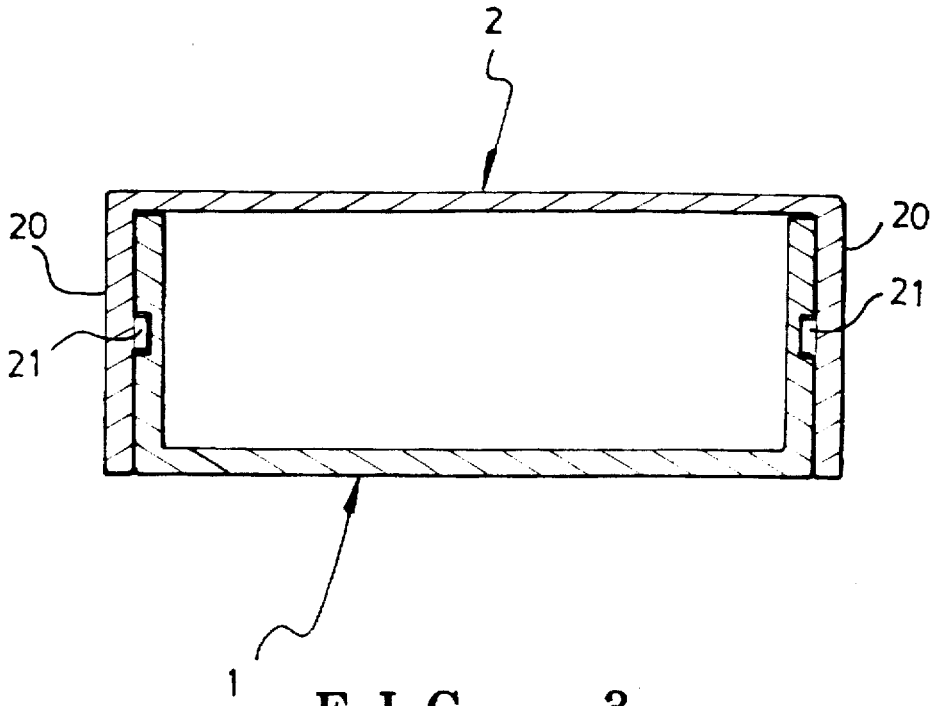
FIG. 3 is a cross sectional view of the stick object storage box shown in FIG. 1.

Referring to FIGS. 1, 2, and 3, a stick object storage box in accordance with the present invention is generally comprised of a box body 1, and a sliding cover 2. The box body 1 has a substantially rectangular shape, a top opening 13 and a top wall 12 at the top side, and two longitudinal sliding grooves 11 respectively disposed at two opposite side walls 10 thereof in the middle. The top wall 12 and the top opening 13 form the top side of the box body 1. The size of the top wall 12 is about one third of the top side of the box body 1, or about equal to one half of the top opening 13. Through the top opening 13, storage items for example floss sticks 3 can be put in the box body 1 or removed therefrom. The sliding cover 2 is adapted for covering over the top opening 13 of the box body 1. When the sliding cover 2 is covered on the top opening 13 of the box body 1, it is disposed in flush with the top wall 12 of the box body 1. The sliding cover 2 comprises two inward stub rods 21 respectively raised from two opposite side walls 20 thereof on the inside near the front end, and respectively moved in the longitudinal sliding grooves 11 of the box body 1. By moving the inward stub rods 21 in the longitudinal sliding grooves 11 between two opposite ends, the sliding box 2 can be set in the closed position as shown in FIG. 1, or an open position as shown in FIG. 2. The sliding cover 2 further comprises two raised portions 24 respectively raised from the two side walls 20 on the inside near the rear end (remote from the stub rods 21), and two fluted surface portions 23 respectively disposed at the side walls 20 on the outside adjacent to the front end. Through the fluted surface portions 23, the sliding cover 2 can be conveniently moved with the hand along the longitudinal sliding grooves 11 of the box body 1. When the sliding cover 2 is moved into the closed position as shown in FIG. 1, the raised portions 24 are respectively forced into the longitudinal sliding grooves 11 of the box body 1 to hold the sliding cover 2 in the closed position.

Figure 4:
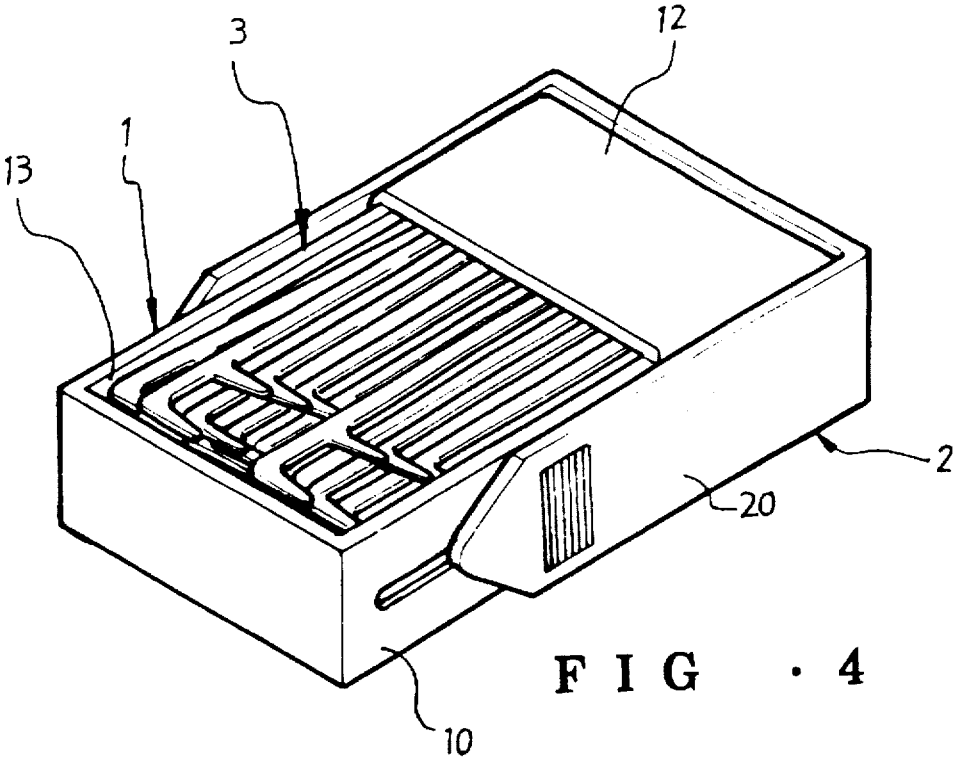
FIG. 4 is still another elevational view of the stick object storage box according to the present invention, showing the sliding cover opened and closely attached to the bottom side of the box body.

Referring to FIG. 4 and FIG. 2 again, when the sliding cover 2 is moved to the open position shown in FIG. 2, it can be turned downwards over the front side 15 (see also FIG. 1), and then turned upwards over the bottom wall 16 (see also FIG. 5) of the box body 1, and then closely attached to the bottom wall 16 of the box body 1.

Figure 5:
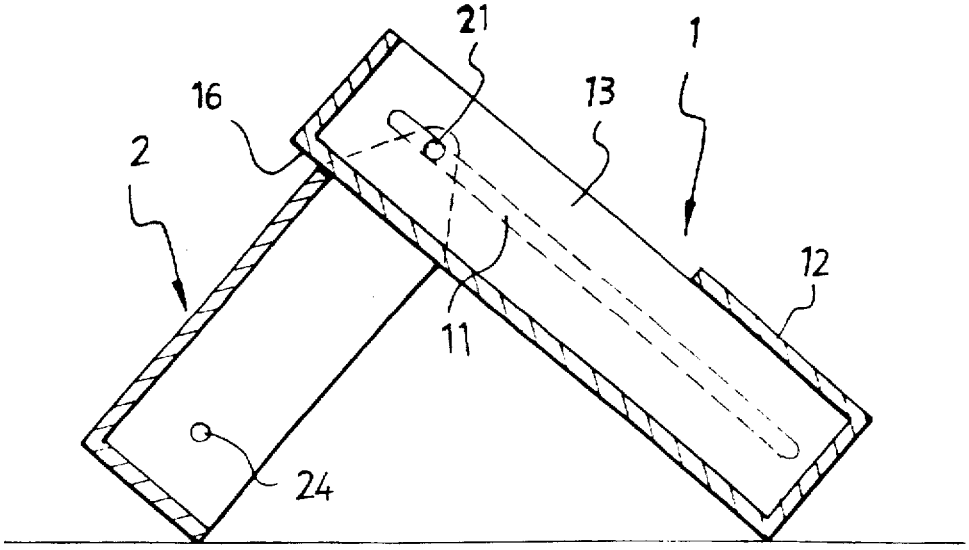
FIG. 5 is a side view in section of the present invention, showing the box body supported on the sliding cover in a tilted position; and, FIG. 6 is another side view in section of the present invention, showing the box body supported on the sliding cover in another tilted position.

Referring to FIG. 5 and FIG. 2 again, when the sliding cover 2 is moved to the open position shown in FIG. 2, it can be turned downwards over the front side 15 (see also FIG. 1) of the box body 1 and set perpendicular to the bottom wall 16 (see also FIG. 5) of the box body 1 to force the front edge 22 (see also FIG. 1) into engagement with the bottom wall 16 of the box body 1, so that sliding cover 2 and the box body 1 can be supported on a flat surface against each other, permitting the box body 1 to be maintained in a tilted position.

Figure 6:
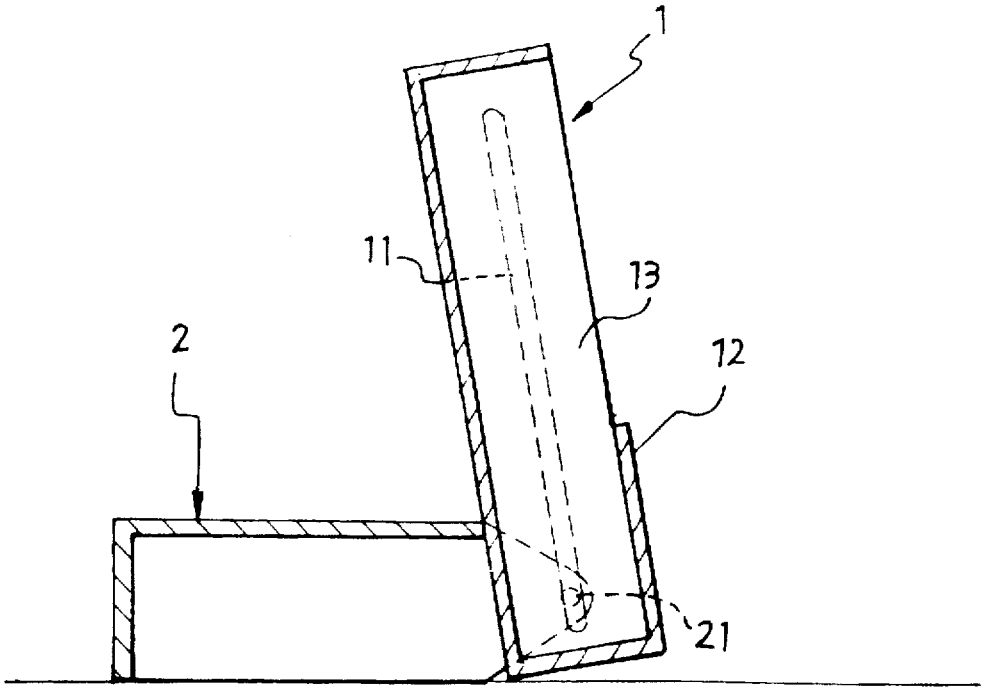

Referring to FIG. 6 and FIG. 2 again, when the sliding cover 2 is moved to the open position shown in FIG. 2, it can be turned downwards over the front side 15 (see also FIG. 1) of the box body 1, and then the stub rods 21 can be moved along the longitudinal sliding grooves 11 of the box body 1 from one end to the other, so that sliding cover 2 can be placed on a flat surface in a horizontal position to support the box body 1 in a tilted position.

While only one embodiment of the present invention has been shown and described, it will be understood that various modifications and changes could be made thereunto without departing from the spirit and scope of the invention disclosed.

What the invention claimed is:

1. A storage box for storing and displaying items, the storage box comprising:

a box body for holding the items, the box body having a generally parallelepiped configuration with a top wall and a top opening in a top side thereof, and opposite body side walls, each body side wall having a longitudinal sliding groove on an outer surface and a bottom wall;

a cover slidably attached to the box body, the cover having a top cover wall for covering the top opening of said box body, the cover having two opposite cover side walls respectively fitting over the side walls of said box body, an inward stub rod respectively extending inwardly from each of the two opposite cover side walls of said sliding cover adjacent to one end of the cover side wall, each first stub rod slidably engaging one of the longitudinal sliding grooves of said body side walls, enabling said cover to be moved relative said box body between a first, closed position in which the top cover wall closes the top opening, a second position in which the top opening is uncovered and a portion of the cover contacts the bottom wall to support the box body in a display position, and a third position in which the top cover wall is adjacent to the bottom wall of the box body and the top opening is uncovered; and, a raised portion extending inwardly from each of the cover side walls and located so as to be forced into one of the longitudinal sliding grooves to releasably hold the cover in the first, closed position.

2. The storage box of claim 1 wherein said sliding cover further comprises a fluted surface portion disposed on each of the cover side walls on outer surfaces thereof to facilitate manual sliding of the cover relative to the box body.

* * * * *

UNITED STATES PATENT AND TRADEMARK OFFICE

CERTIFICATE OF CORRECTION

PATENT NO. : 5,732,820
DATED : March 31, 1998
INVENTOR(S) : Hung Chie TSAI

It is certified that error appears in the above-indentified patent and that said Letters Patent is hereby corrected as shown below:

On the title page item [76], correct the inventor's name to read as follows:

--Hung Chie TSAI--

Signed and Sealed this

Twenty-first Day of July, 1998

*Attest:*

*Attesting Officer*

BRUCE LEHMAN

*Commissioner of Patents and Trademarks*